159-61

7/1/86 SR

OR 4,597,451

United States Patent [19]

Moore et al.

[11] Patent Number: 4,597,451

[45] Date of Patent: Jul. 1, 1986

[54] FIRE AND EXPLOSION DETECTION AND SUPPRESSION

[75] Inventors: Peter E. Moore, Reading; David H. J. Davies, Marlow, both of England

[73] Assignee: Graviner Limited, Slough, England

[21] Appl. No.: 647,566

[22] Filed: Sep. 5, 1984

[30] Foreign Application Priority Data

Sep. 9, 1983 [GB] United Kingdom ..... 8324136

[51] Int. Cl.[4] ..... A62C 37/04

[52] U.S. Cl. ..... 169/61; 169/16; 169/56; 340/511; 340/577; 340/587

[58] Field of Search ..... 169/16, 56, 60, 61; 340/501, 511, 521, 522, 577–579, 587, 600

[56] References Cited

U.S. PATENT DOCUMENTS

| | | | |
|---|---|---|---|
| 3,884,304 | 5/1975 | Messerschmidt et al. | 169/16 |
| 3,993,138 | 11/1976 | Stevens et al. | 169/61 |
| 4,082,148 | 4/1978 | Willms | 169/61 |
| 4,388,616 | 6/1983 | Machida | 340/587 |
| 4,414,542 | 11/1983 | Farquhar et al. | 340/587 X |
| 4,437,089 | 3/1984 | Achard | 340/587 X |

FOREIGN PATENT DOCUMENTS

| | | |
|---|---|---|
| 1270388 | 10/1970 | United Kingdom . |
| 2022409 | 2/1979 | United Kingdom . |
| 2020971 | 2/1979 | United Kingdom . |
| 2099298 | 5/1982 | United Kingdom . |

*Primary Examiner*—Jeffrey V. Nase
*Attorney, Agent, or Firm*—John K. Williamson

[57] ABSTRACT

A fire detection system comprises a plurality of individual fire detection-suppression units which all have their own individual standby electrical power supply. Each has a radiation detector for fire detection and its own source of fire suppressant. In the event of any of the units detecting a large fire, it automatically releases suppressant from its own source. In addition, all the units are connected to a master control station via a data bus. Any individual unit sensing a large fire signals this fact to the master control station which then enables the immediately adjacent individual units so as to permit those units, only, to release their fire suppressant if and only if they detect at least a "small" fire (and also provided that the master control station determines that not less than a predetermined number of the units still have functional fire suppressant sources). There is thus a measure of central control and monitoring, and yet each unit is capable of operating completely independently in the event of its detection of a large fire. An emergency button provides a completely independent means of activating all the units. The master control station is also capable of activating all the units.

10 Claims, 4 Drawing Figures

FIRE AND EXPLOSION DETECTION AND SUPPRESSION

BACKGROUND OF THE INVENTION

The invention relates to fire and explosion detection and extinguishing or suppression and more specifically to a system for protecting a large area against fire or explosion such as a ship or part of a ship for example. In this Specification (including the claims), unless the context otherwise indicates, the term "fire" includes "explosion" and the term "suppression" and its grammatical derivatives includes "extinguishing" and grammatical derivatives.

SUMMARY OF THE INVENTION

According to the invention there is provided a fire detection and suppression system, comprising a plurality of individual fire detection-suppression means placed at different positions within an area to be protected and each capable of operating independently, in response to its detection of a serious fire, to release a fire suppressant, and a master control means connected to all of the fire detection-suppression means and operative in response to any of them detecting a serious fire to cause at least one other detection-suppression means to release fire suppressant if that other means is detecting a less serious fire.

According to the inventiom, there is also provided a fire and suppression system, comprising a plurality of fire detection-suppression means for distribution within an area to be protected, each detectionsuppression means including fire detection means for producing a first control signal in response to the detection of a fire condition exceeding a first but not a second threshold and a second control signal in response to a fire condition exceeding the second threshold and each including fire suppression means connected to release a fire suppressant in response to the respective second control signal, and master control means connected to all the fire detectionsuppression means to receive the control signals therefrom and operative in response to receipt of a said second control signal to cause at least some of any of the fire suppression means associated with a fire detection means producing a said first control signal to release the fire suppressant.

DESCRIPTION OF THE DRAWINGS

A fire detection and suppression system embodying the invention will now be described, by way of example only, with reference to the accompanying drawings in which.

DESCRIPTION OF PREFERRED EMBODIMENTS

The system to be described is in this example for suppressing hydrocarbon fires in ships, though is not restricted to such an application.

Figure 1:
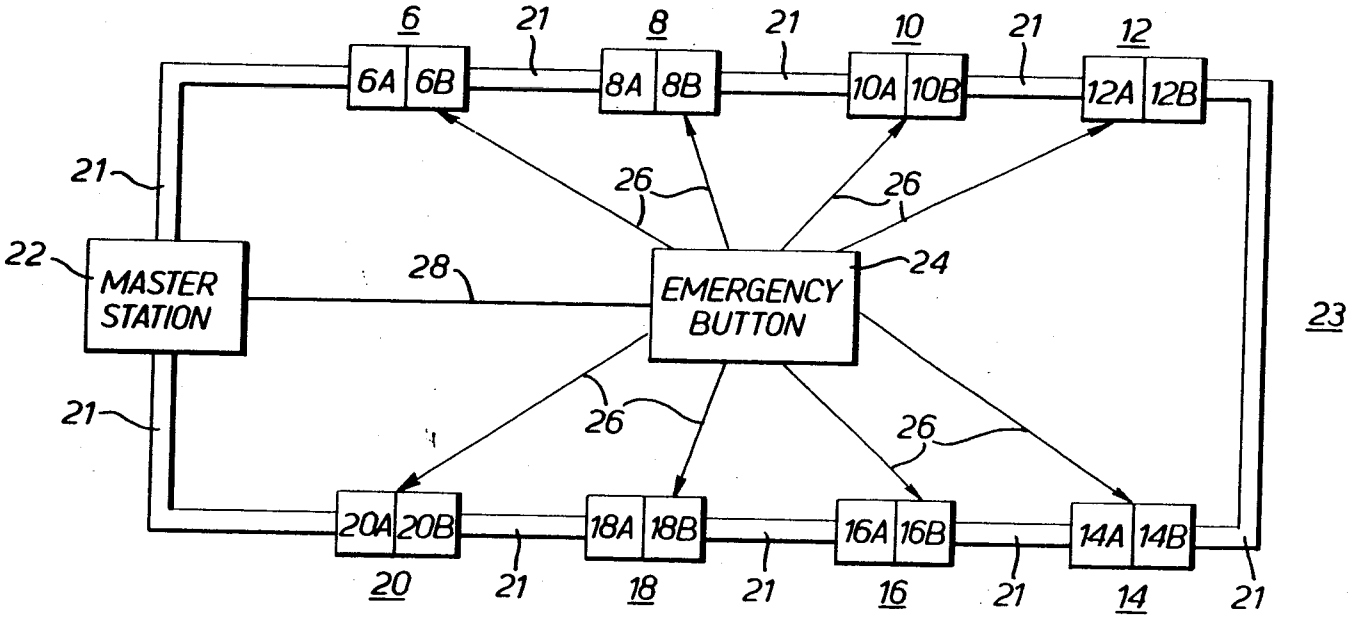
FIG. 1 is a block diagram of the system.

FIG. 1 shows a block diagram of the system. This Figure shows eight (in this example) fire detection and suppression units, 6, 8, 10, 12, 14 16,18 and 20. Each unit comprises a detector head 6A, 8A, 10A, 12A, 14A, 16A, 18A, 20A and a fire suppressor, 6B, 8B, 10B, 12B, 14B, 16B, 18B, 20B and associated circuitry not shown in FIG. 1. Each fire suppressor comprises in this example a bottle containing Halon fire suppressant which can be discharged from the bottle under pressure by an electrical signal. All eight units are electrically connected by a data bus 21 to a master station 22. The eight units are physically positioned around an area 23 to be protected. In this example, this is an area in a ship, and in such an example the master station 22 could be positioned in the ship control centre.

Each unit, 6, 8, 10, 12, 14, 16,18, 20 incorporates its own electrical standby power supply.

All the units 6 to 20 are connected to a manually operable emergency button 24 via respective lines 26. The master control unit 22 is connected to button 24 by a line 28.

Figure 2:
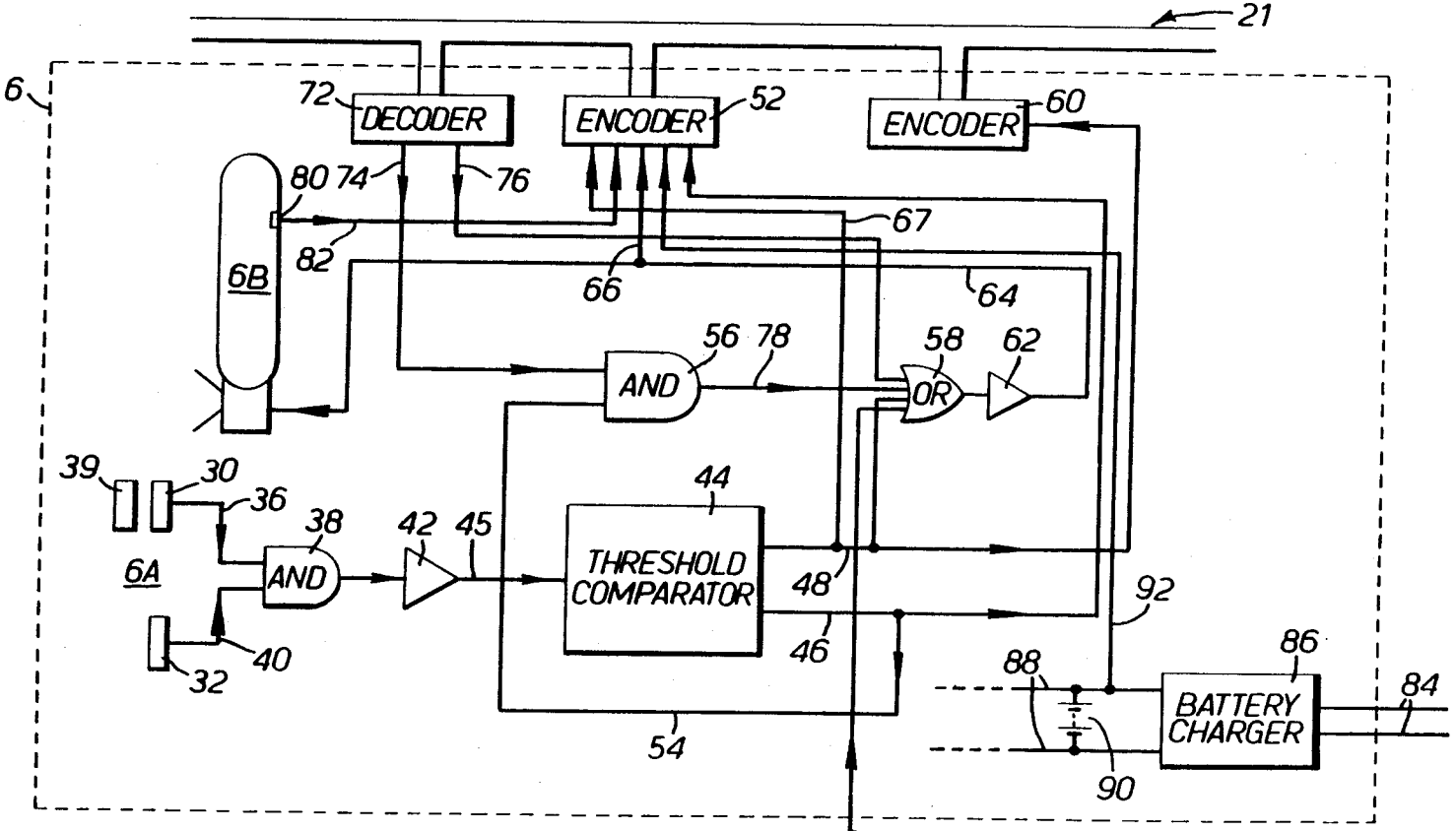
FIG. 2 is a block diagram of one of the detector/suppressor units used in the system.

FIG. 2 shows the unit 6 in more detail. As shown, it comprises two radiation sensors 30 and 32. Sensor 30 may be in the form of a thermopile and is associated with a filter 34 having a narrow radiation passband at 4.4 microns. Infra-red radiation at this frequency therefore falls on the sensor 30 which produces a corresponding electrical signal on a line 36 to one input of an AND gate 38. Sensor 32 may be a silicon photo-diode which is responsive to radiation in a narrow band centred at 0.9 microns and produces a corresponding electrical signal on the line 40 to the AND gate 38 in response to such radiation. Provided that sensor 32 receives at least a minimum (relatively low) level of radiation at 0.9 microns, its corresponding electrical signal opens the AND gate 38 so as to feed the analogue signal on line 36, representing the level of radiation at 4.4 microns received by the sensor 30, to an amplifier 42.

Amplifier 42 is fed to a threshold comparator 44 which compares the amplitide of the amplifier output with two internally generated thresholds. The first of these thresholds corresponds to a small fire and the second threshold corresponds to a large fire. If the signal on line 45 from amplifier 42 exceeds the first threshold (but not the second threshold) a first or "low" control signal is produced on a line 46, but if the signal on line 45 exceeds the second threshold, a second or "high" control signal is produced on a line 48 (but not on line 46).

The first threshold (corresponding to the "small" fire) may simply be a low magnitude threshold corresponding, for example, to the radiation level which would be emitted from a 65 millimeter panfire at a distance of 1,200 millimeters. Instead, or in addition, the first threshold may be or include a rate of rise threshold. In other words, the signal would only be produced on line 46 if the signal on line 45 was rising at at least a relatively low rate.

The second threshold (corresponding to a "large" fire) could comprise simply a higher magnitude threshold corresponding to a fire significantly larger than the 65 millimeter panfire at 1,200 millimeters or could consist of or include a rate of rise threshold—so that the signal on line 48 would only be produced if the signal on line 45 was rising at at least a relatively high rate.

Line 46 is connected to an encoder unit 52 and also, via a line to one input of an AND gate 56.

Line 48 is connected to one input of an OR gate 58 and also to an encoder 60.

The output of the OR gate 58 is connected through an output unit 62 to the fire suppressor 6b of the unit under discussion via the line 64.

Line 64 is also connected to the encoder 52 via a line 66. Line 48 is connected to the encoder 52 by a line 67.

The encoders 52 and 60 encode the signals which they respectively receive and feed corresponding data output signals to the master control unit 22 via the data bus 21.

In a manner to be explained, information is also received from the master control unit 22 via the data bus 21 and this data is decoded by a decoder 72 and output (in a manner to be explained) on the line 74 connected to the second input of the AND gate 56 and on a line 76 connected to the second input of the OR gate 58.

The third input of the OR gate 58 is received via a line 78 and from the AND gate 56.

A presure transducer 80 monitors the pressure of the suppressant in the suppressor 6B and produces a corresponding electrical signal on a line 82 which is encoded by the encoder 52 and fed to the master control unit 22 via the data bus 21.

An electrical power supply for the unit 6 is received via power supply lines 84 (connected in parallel to all the units). Lines 84 feed a battery charger and regulator unit 86 which produces a stable output supply at the required relatively low voltage on lines 88 and also maintains a nickel-cadmium battery 90 charged. Lines 88 are connected to provide a power supply to all the necessary components of the unit 6 via connections not shown. A line 92 monitors the voltage of the nickel-cadmium battery 90 and encoder 52 feeds corresponding data to the master control unit 22 via the data bus 21.

Line 26 from the emergency button 24 (see FIG. 1) is connected to the fourth input of the OR gate 58.

The encoders 52 and 60 encode the data which they transmit onto the data bus in combination with suitable address signals indicating the identity of the unit (unit 6 in this example) from which the data originates. Correspondingly, the decoder 72 is operative to decode data on the data bus which is addressed to the particular unit.

The operation of the system will now be described with reference to FIGS. 1 and 2.

In the absence of a fire within the area to be protected, the radiation (if any) received by sensors 30 and 32 is such that AND gate 38 produces no output. Neither line 46 nor line 48 is therefore producing a control signal and this fact is signalled to the master control unit 22 via encoders 52 and 60 and the data bus 21. Likewise, all the other fire detection-suppression units will be in the same state and will signal correspondingly to the master control unit.

If a hydrocarbon fire begins within the area of view of the sensors 30 and 32 of the unit 6, significant radiation will be emitted at 4.4 microns (corresponding to carbon dioxide in the fire). In addition, significant radiation will be emitted at 0.9 microns. AND gate 38 will therefore open and pass the signal from sensor 30 to the threshold comparator 44 via amplifier 42. Assuming that the fire is a large fire (as defined above), a "high" control signal will be produced on line 48 via OR gate 58 and line 64 will be energised to operate suppressor 6B causing it to release suppressant into the area to be protected. The signals on lines 64 and 48 will be fed to the encoder 52 via lines 66 and 67 and will thus be passed to the master control unit 22. In addition, release of the suppressant will be signalled to the master control unit via line 82 and the encoder 52. Finally, line 48 will signal to the master control unit via encoder 60.

Any other unit which detects the same fire and which receives such radiation that its threshold comparator produces a "high" signal on its line 48 will operate in identical manner and will cause its fire suppressor to release suppressant.

If the radiation detected by sensors 30 and 32 corresponds merely to a "small" fire (as defined above), the threshold comparator 44 will produce a "low" signal on line 46, and line 48 will not be energised. The existence of the low control signal will be transmitted to the master control unit 22 via the encoder 52. In addition AND gate 56 will be enabled. Any other unit whose sensors also detect a "small" fire will operate likewise.

The master control unit 22 continually monitors the status of all the fire detection-suppression units 6 to 20. When it detects that any one of them is producing a "high" control (on its line 48),the master control unit 22 addresses a "status 1" signal to those fire detection-suppression units which are immediately physically adjacent to the unit producing the high control signal. The "status 1" signal is detected by decoder 72 and produces a signal on line 74. If the unit is producing a low control signal on line 46, AND gate 56 will have been enabled via line 54 and thus line 78 will be energised and will cause the suppressor to release suppressant, this fact being signalled back to the master control unit and via line 82 of that unit. If the immediately adjacent units are not producing low control signals, then of course the signal on line 74 wil not cause release of suppressant by them.

The master control unit may also operate to cause all of the units to activate their suppressors to release suppressant. It does this by addressing a "status 2" signal to all units via the data bus. This is decoded by the decoder 72 in each unit and energises line 76 which operates the suppressor via the OR gate 58. Release of suppressant in each unit is signalled back to the master control unit via line 82 in each unit. Mass release of suppressant or "flooding" of the area in this way may be carried out by means of a manual over-ride signal supplied to the master control unit.

Mass release of suppressant may also be carried out, completely independently of the master control unit 22, by means of the emergency button 24 (FIG. 1). This energises all the lines 26. As shown in FIG. 2, line 26 operates the suppressor via the OR gate 58.

The purpose of line 28 (FIG. 1) is to provide an additional or back-up path by means of which the master control unit 22 may cause mass release of suppressant. Thus, when the master control unit 22 calls for mass release of suppressant, corresponding signals are not only fed to all of the individual units via the data bus 21 but such a signal is also fed to the emergency button 24 via line 28 and causes the emergency button to energise all the lines 26.

The master control station 22 carries out a number of other functions. For example it may be programmed to monitor the statuses of all the individual units so as to sense when at least a predetermined number of them either have released their suppressant or their suppressors are non-functional for some other reason (as sensed by the pressure transducer 80). When this predetermined number is exceeded, the master control station will no longer react to receipt of a high control signal (on line 48) from any of the units by sending a "status 1" signal to the immediately adjacent units. In other words, those immediately adjacent units will not release their suppressant even if they do produce a low control signal on their lines 46. This preserves at least some of the units ready for manual operation in the event of an emergency. Of course, each of the units can still operate to release suppressant in the event of its producing a high control signal; the master control station cannot prevent this.

The master control station also monitors the control signals produced by all the individual units 6 to 20 and displays and/or records the signals being produced, along with the pressure within each transducer and the state of its power supply. Advantageously, it carries out this process by progressing through a sequence of operations in which it addresses "status demand" signals to each of the unis 6 to 20 in turn, in response to which they output the required data on to data bus 21.

The purpose of the encoder 60 is to transmit a "interrupt" signal to the master control station to interrupt its sequence of operations in the event of a high control signal being produced by any one unit. This may be necessary or advantageous when there are a relatively large number of units since the sequence of operations of the master control station will in such circumstances take a relatively long time and it is desirable that it be interrupted when a high control signal is produced by any unit so as to be able to react immediately to that signal. When there are only a small number of individual units in the system, the provision of this "interrupt" facility may not be necessary.

The purpose of the sensor 32 in each unit 6 to 20 is to enable the system to discriminate against spurious (that is, non-fire) sources of radiation which may be present in the area 23. For example, if there are hot surfaces (of machinery and the like) in the area, these may emit sufficient radiation at 4.4 microns to produce a significant signal on line 36. However, such sources will emit insufficient radiation at 0.9. microns to enable gate 38. Such spurious radiation sources will therefore not cause production of a high or low control signal.

Figure 3:
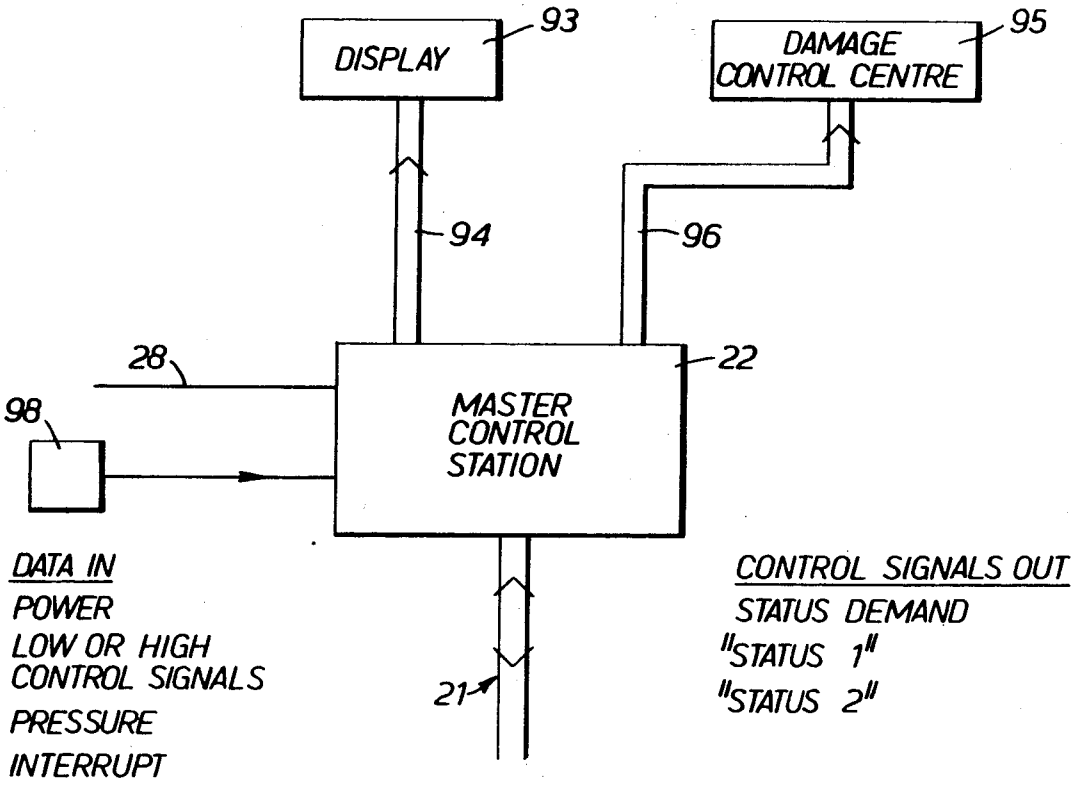
FIG. 3 is an outline block diagram of a master station in the system and showing operations which it carries out in the system.

FIG. 3 shows the operations and data signals supplied into and out of the master control station 22 and items in FIG. 3 corresponding to items in the other Figures are correspondingly referenced.

As shown, the master control station 22 is connected via the data bus 21 to produce the listed output signals; that is, the "status 1" signal, the "status 2" signal and the "status demand" signal.

The station 22 receives the listed input signals from each unit 6 to 20; that is, whether it is producing a low or high control signal (on lines 46 and 48), the pressure in its suppressor, the state of its electrical power supply (and any other parameters monitored).

FIG. 3 shows the master control station 22 connected to a display unit 93 via a data bus 94 for displaying the status as of all the units, and also shows it connected to the ships damage control centre 95 via data bus 96.

A manual control 98 is connected to the master station 22 to cause it to produce mass release of suppressant or flooding of the area in the manner explained.

Figure 4:
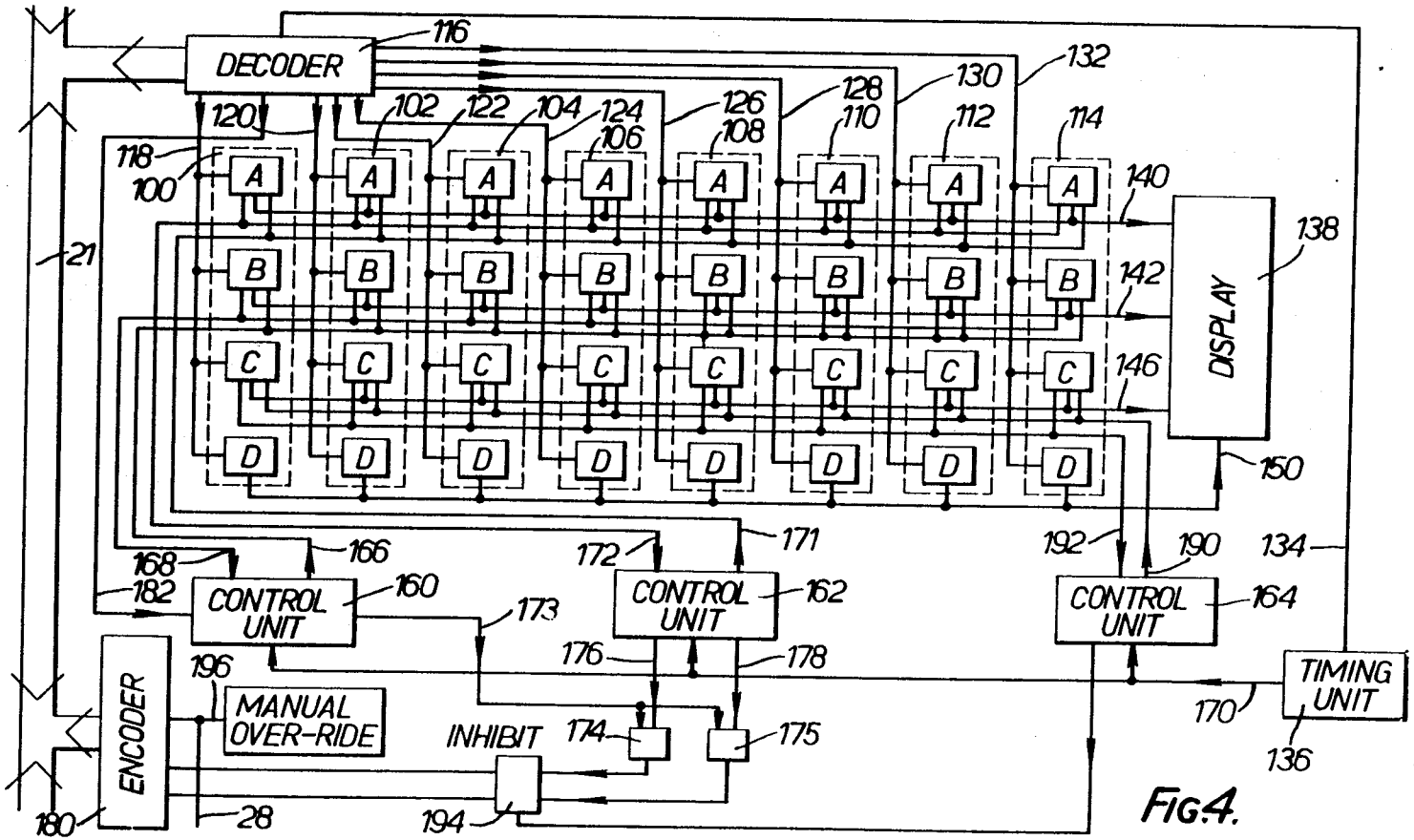
FIG. 4 is a more detailed block diagram showing one form which the master station of FIG. 3 may take.

FIG. 4 illustrates in more detail one form which the master station 22 may have.

As shown, the master station 22 incorporates storage units 100, 102, 104, 106, 108, 110, 112 and 114 of any suitable form, each of which has four storage sections, labelled A, B, C and D. There is a respective storage unit provided for each of the eight fire detection-suppression units 6 to 20, shown in this example. Storage unit 100 corresponds to detection-suppression unit 6 and similarly for the remainder in numerical order.

The storage sections A are for storing "low" control signals (from the respective detection-suppression units), the storage sections B are for storing "high" control signals, the storage sections C are for storing the status of the suppressors (e.g. 6B) in the detection-suppression units, that is, for storing whether, for example, each such suppressor has or has not discharged its suppressant, and the storage sections D are for storing the status of the standby power unit 90 in each detection-suppression unit.

A decoder unit 116 is connected to decode signals received on the data bus 21 (from the detection-suppression units). Decoder unit 116 decodes the data arriving on the data bus 21 and relating to each of the detection-suppression units. The decoded data is passed to the storage units 100 to 114 by means of respective data channels 118 to 132. If any particular detection-suppression unit 6 to 20 is producing a "low" control signal, this information will be output by the decoder 116 onto the appropriate one of the channels 118 to 132 and stored in the appropriate storage section A. Similarly, if any of the detection-suppression units is producing a "high" control signal, the decoder 116 will ensure that this information is stored in the appropriate storage section B; and so on for information relating to the operational status of the detection-suppression units and for the status of their standby power unit 90. The decoder 116 may decode the data on the data bus 21 serially, that is, it may decode the data arriving in respect of each of the detection-suppression units in turn for example. Such serial operation may be controlled by means of a line 134 from a timing unit 136. In certain configurations additional storage units (not shown in FIG. 4) will be allocated to store diagnostic operational status of detection-suppression units—thus providing fault identification.

All the storage sections A are connected to a data output channel 140 which in turn is connected to a display unit 138 by means of a channel 140. Similarly, all the storage units B are connected to a data output channel 142 and thence to the display unit 138; all the storage sections C are connected to a data output channel 146 and thence to the display unit 138, and all the storage sections D are connected to a data output channel 150 and thence to the display unit 138. By this means, the display unit 138 continually displays the status of all the detectionsuppression units, displaying which of them is producing a "low" signal, and which of them is producing a "high" control signal. In addition, it displays the status of the suppressor in each detection-suppression unit, that is, whether it is available or not for discharge of suppressant, and the status of the battery 90 in each of the detectionsuppression units. In certain configurations display unit 138 will indicate a "fault" condition of detection-suppression uints.

The master control station 22 also incorporates three control units 160, 162 and 164. The control unit 160 has an output address channel 166 which is connected to each of the storage sections B and by means of which it can address each of them in turn and cause it to feed back to the unit 160, on a data channel 168, data indicating whether or not that particular storage section B is storing a "high" control signal from the corresponding detection-suppression unit. The unit 160 is controlled to monitor the storage sections B sequentially by signals from the timing unit 136 on a line 170.

The control unit 162 is connected by means of an output address channel 171 to monitor the states of the storage sections A and operates in synchronism with the control unit 160. However, the control unit 162 is programmed so that it does not monitor the storage section A of the same storage unit 100 to 114 as the control unit 160 is monitoring at that time. Instead, the control unit 162 is arranged so that, when the control unit 160 is monitoring the storage section B of a particular storage unit, the control unit 162 is monitoring the storage sections A of the storage units corresponding to the immediately adjacent detection-suppression units. For example, it could be monitoring those detection-suppression units which are immediately on opposite sides of a particular detection-suppression unit. However, other arrangements are possible. The control unit 162 is connected to be controlled by the timing signals on line 170. Data indicating whether the particular storage sections A are storing "low" control signals or not is fed back to the control unit 162 on a channel 172. In certain configurations diagnostic "fault" information will also be monitored e.g. from the additional storage units by control units 160 and 162. If a fault is indicated in operation any enable signal will be suppressed.

In operation, the timing signals on line 170 cause the control unit 160 to monitor the storage sections A in turn. If any of them is storing data representing a "high" control signal, an enable signal is fed out on a line 174 to AND gates 174 and 175. As each section A is monitored by the control unit 160, the control unit 162 monitors the storage sections A corresponding to the physically adjacent detection-suppression units. If they, or either of them, contains data representing a "low" control signal, corresponding signals are output by the control unit 162 on lines 176 and 178 connected to the gates 174 and 175. As these gates are enabled, the signals on lines 176 and 178 pass through to an encoder 180 which transmits signals to the corresponding detection-suppression units for setting off their suppressors.

The foregoing assumes that the control unit 160 monitors the storage sections B in sequence (with the control unit 162 operating in synchronism in the manner described). However, the master control station may have the "interrupt" facility described above in which an "interrupt" signal can be generated by the encoder 60 (FIG. 2) in a detectionsuppression unit producing a "high" control signal. Such an "interrupt" signal may be decoded by the decoder 116 in the master station 22 (FIG. 4) and fed to the control units 160 and 162 by means of a channel 182. Any such "interrupt" signal will be associated with data identifying the detection-suppression unit from which the signal originates and this data will cause the control unit 160 to inspect the section B of the adjacent storage unit and will also cause the control unit 162 to inspect the storage sections A of the physically adjacent detection-suppression units in the manner defined.

The control unit 164 is controlled by the timing signals on the line 170 and has an output address channel 190 by means of which it monitors the storage sections C of all the storage units 100 to 114 in sequence. As it monitors each storage section C in this way, the data in that storage section, relating to the status of the suppressor in the corresponding detection-suppression unit, is fed back to the control unit 160 on a data channel 192. In this way, the control unit 164 monitors the number of detection-suppression units whose suppressors have discharged. When this number exceeds a predetermined threshold, the control unit 160 operates an inhibit gate 194 to prevent the control unit 162 from causing discharge of suppressant by any of the detection-suppression units 6 to 20.

Also shown in FIG. 4 is means by which a manual over-ride signal may be generated on a line 196 and fed via the encoder 180 to cause discharge of suppressant by the suppressors of all the detection-suppression units irrespective of the number of detection-suppression units already operated. Energisation of line 196 also provides a back-up path for the same purpose via the emergency button 24 in the manner explained.

Various modifications may be made to the arrangement of the master control station 22 and FIG. 4 illustrates merely one possible implementation. It may be advantageous to implement the master control station by means of an appropriately programmed micro processor.

From all the foregoing it will be seen that each of the fire detection-suppression units 6 to 20 is capable of operating completely independently of each other and independently of the master station 22 to release fire suppressant in the event of its detection of a "large" fire. In addition, the master control station can allow each of the units immediately adjacent to a unit which has detected a large fire to release the suppressant provided low threshold detection of flame is satisfied. In some applications the system may be configured to activate suppressors adjacent to such a fire detection-suppression unit although the detectors associated with these detection-suppression units have not met the threshold defined by "small" fires. Finally, the units can all be caused to release fire suppressant either by means of the master control station 22 or by means of the emergency button 24. In the event of any damage or malfunction which isolates any or all of the fire detection-suppression units from the data bus and/or from the master control station 22 and/or from the emergency button 24, each of the individual units is still capable of operating to release fire suppressant in the event of detection of a large fire.

In certain applications the control station 22 may be backed up by a further control station either on data bus 21 or a second parallel data bus.

What is claimed is:

1. A fire detection and suppression system, comprising a plurality of fire detection-suppression means for distribution within an area to be protected, each fire detection-suppression means including fire detection means for producing a first control signal in response to the detection of a fire condition exceeding a first but not a second threshold and a second control signal in response to a fire condition exceeding the second threshold and each fire detection-suppression means including fire suppression means connected to release a fire suppressant in response to the respective second control signal, and master control means connected to all the fire detection-suppression means to receive the control signals therefrom and operative in response to receipt of a said second control signal from any one of said fire detection-suppression means to cause release of the fire suppressant by any other of said fire detection-suppression means which is both adjacent to said one fire detection-suppression means and producing a said first control signal.

2. A system according to claim 1, in which the master control means is operative to respond to receipt of a said second control signal by causing release of fire suppressant only from any fire suppression means which is associated with a fire detection means producing a said first control signal and which is physically adjacent to the fire detection means producing the second control signal.

3. A system according to claim 1, in which each fire detection-suppression means includes its own electrical power supply whereby its fire detection means is capable of producing a said second control signal, and its fire suppression means is capable of releasing suppressant in response thereto, in the event of its becoming isolated from the master control means.

4. A system according to claim 1, in which the master control means includes means for monitoring all the fire detection-suppression means and generating information indicating which of them is producing a said first control signal, which of them is producing neither said control signal.

5. A system according to claim 1, in which each fire detection-suppression means includes infra-red radiation sensing means.

6. A system according to claim 5, in which the infra-red radiation sensing means comprises means sensitive to radiation at 4.4 microns.

7. A system according to claim 5, in which the infra-red sensing means comprises means sensitive to radiation at 0.9 microns.

8. A system according to claim 1, in which the master control means includes means selectively operable to inhibit release of fire suppressant by any of the fire detection-suppression means.

9. A system according to claim 1, including emergency means separate from the master control means and manually operable to cause all the fire detection-suppression means to release fire suppressant.

10. A system according to claim 9, in which the master control means is connected to the emergency means so as to be capable of operating the emergency means.

* * * * *